US007520777B2

(12) United States Patent
Cheng et al.

(10) Patent No.: US 7,520,777 B2
(45) Date of Patent: Apr. 21, 2009

(54) MOVABLE TERMINAL CONNECTING MECHANISM

(75) Inventors: Ching-Wen Cheng, Taoyuan (TW); Chien-Hua Chiao, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/938,566

(22) Filed: Nov. 12, 2007

(65) Prior Publication Data

US 2009/0035969 A1 Feb. 5, 2009

(30) Foreign Application Priority Data

Jul. 30, 2007 (TW) ..... 96127844 A

(51) Int. Cl.
*H01R 13/60* (2006.01)

(52) U.S. Cl. ..... 439/538; 439/638

(58) Field of Classification Search ..... 439/528, 439/638

See application file for complete search history.

(56) References Cited

U.S. PATENT DOCUMENTS 6,435,903 B1 * 8/2002 Nelson ..... 439/528
7,001,219 B2 * 2/2006 Dallmeier ..... 439/638

* cited by examiner

*Primary Examiner*—Truc T Nguyen

(57) ABSTRACT

A movable terminal connecting mechanism of an electrical appliance includes a support part, a carrier part and a first terminal block. The support part is fixed within a frame body of the electrical appliance and includes at least one first retaining structure. The carrier part includes at least one second retaining structure corresponding to the first retaining structure. The carrier part is moved with respect to the support part when the second retaining structure is moved with respect to the first retaining structure. The first terminal block is fixed on the carrier part to be coupled with an external cable. The first terminal block is either partially exposed outside the entrance of the frame body to implement a wiring task of wiring the first terminal block with the external cable, or stored in a receptacle of the frame body.

20 Claims, 9 Drawing Sheets

2

MOVABLE TERMINAL CONNECTING MECHANISM

FIELD OF THE INVENTION

The present invention relates to a terminal connecting mechanism, and more particularly to a movable terminal connecting mechanism.

BACKGROUND OF THE INVENTION

Uninterruptible power supply (UPS) apparatuses are widely used to provide stable power to loads. If the voltage of the utility power is subject to a sudden variation or interruption, the power to the loads could be maintained at an applicable level by using the UPS apparatus.

Referring to FIG. 1, a schematic backside view of an uninterruptible power supply (UPS) apparatus is illustrated. The UPS apparatus 1 of FIG. 1 principally includes a case 11 and a plurality of UPS units 12. The backside of each UPS unit 12 has one or more connection ports 13 and several sockets 14. Generally, for operative convenience, the UPS units 12 are distant from the floor. Since the terminal block 10 for wiring to the external power cable needs to be configured at the lower portion of the backside of the case 11, the wiring task is troublesome.

Moreover, for maintaining an electrical safety distance, the terminal block 10 is usually disposed within a receptacle 15, which is located at the lower portion of the backside of the case 11. During the wiring task is done, the worker may only partially view the terminal block 10 through the entrance 16 of the receptacle 15. Before connecting external cables (not shown) with the UPS apparatus 1, the works needs to bend down or lower the head to the upper peripheral of the entrance 16 of the receptacle 15 in order to view the wiring holes, which are disposed within the receptacle 15 and at the upper edge of the terminal block 10. Therefore, the wiring task is both labored and time-consuming.

As known, if the entrance 16 of the receptacle 16 is broadened, the visual angle of the terminal block 10 is expanded and the operative space is increased. Providing that the area of the backside of the case 11 is unchanged, the space utilization for configuring the connection ports 13 and the sockets 14 is reduced.

In views of the above-described disadvantages resulted from the conventional method, the applicant keeps on carving unflaggingly to develop a movable terminal connecting mechanism according to the present invention through wholehearted experience and research.

SUMMARY OF THE INVENTION

It is an object of the present invention to provide a movable terminal connecting mechanism for implementing the wiring task in a convenient and user-friendly manner.

Another object of the present invention provides a movable terminal connecting mechanism capable of being stored within the electrical appliance, thereby increasing electrical safety.

In accordance with an aspect of the present invention, there is provided a movable terminal connecting mechanism of an electrical appliance. The electrical appliance includes a frame body, which has a receptacle and an entrance. The movable terminal connecting mechanism includes a support part, a carrier part and a first terminal block. The support part is fixed within the frame body and includes at least one first retaining structure. The carrier part includes at least one second retaining structure corresponding to the first retaining structure. The carrier part is moved with respect to the support part when the second retaining structure is moved with respect to the first retaining structure. The first terminal block is fixed on the carrier part to be coupled with an external cable. The first terminal block is either partially exposed outside the entrance of the frame body to implement a wiring task of wiring the first terminal block with the external cable, or stored in the receptacle.

In accordance with another aspect of the present invention, there is provided a movable terminal connecting mechanism of an electrical appliance. The electrical appliance includes a frame body, which has a receptacle and an entrance. The movable terminal connecting mechanism includes a support part, a carrier part, a first terminal block and a second terminal block. The support part is fixed within the frame body and includes at least one first retaining structure. The carrier part includes at least one second retaining structure corresponding to the first retaining structure. The carrier part is moved with respect to the support part when the second retaining structure is moved with respect to the first retaining structure. The first terminal block is fixed on the carrier part to be coupled with an external cable. The first terminal block is either partially exposed outside the entrance of the frame body or stored in the receptacle. The second terminal block may interconnect the first terminal block and the external cables when the first terminal block is partially exposed outside the entrance of the frame body.

The above contents of the present invention will become more readily apparent to those ordinarily skilled in the art after reviewing the following detailed description and accompanying drawings, in which:

BRIEF DESCRIPTION OF THE DRAWINGS

FIG. 5(*b*) is a schematic partial backside view illustrating that the movable terminal connecting mechanism of the electrical appliance is shielded by the cover plate;

FIG. 7(*b*) is a schematic partial perspective view illustrating the connection between the shielding body and the frame body.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
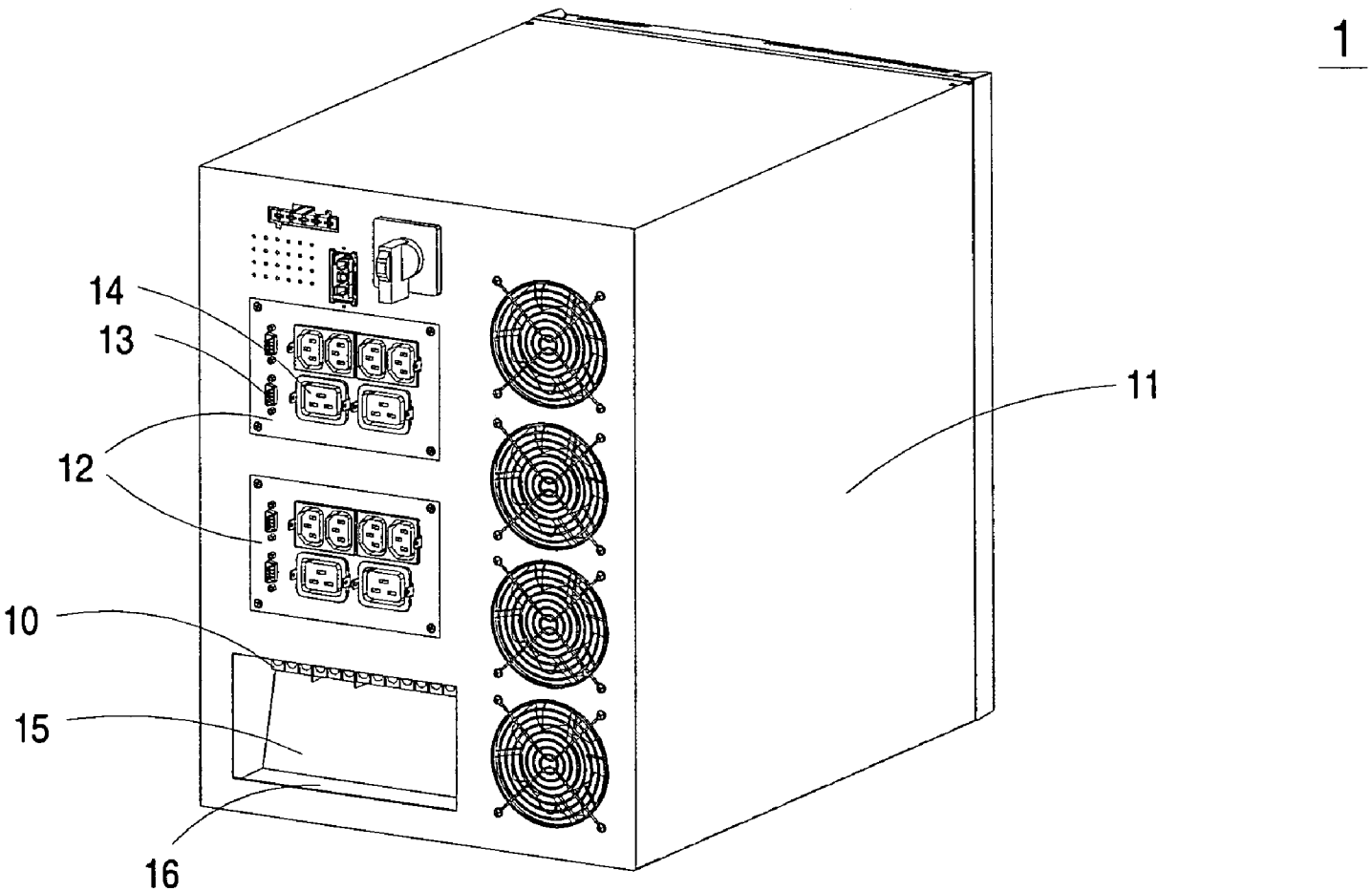
Fig. 1 Prior Art
FIG. 1 is a schematic backside view of an uninterruptible power supply (UPS) apparatus.
Figure 2:
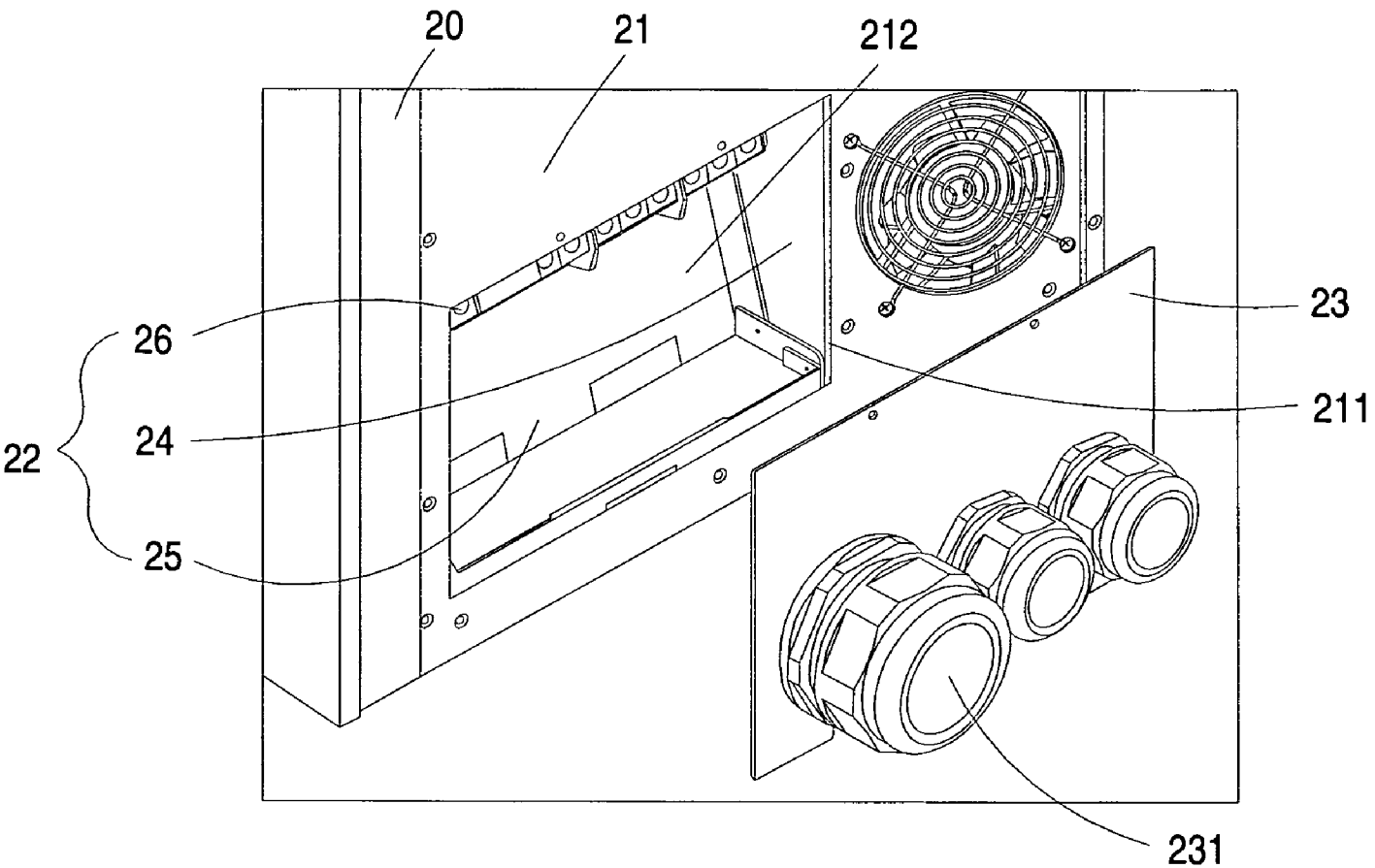
FIG. 2 is a schematic partial backside view illustrating the lower portion of an electrical appliance according to the present invention.

Please refer to FIG. 2, which is a schematic partial backside view illustrating the lower portion of an electrical appliance according to the present invention. The electrical appliance is for example a power supply apparatus or an uninterruptible power supply (UPS) apparatus. As shown in FIG. 2, the electrical appliance 2 principally includes a case 20. The case 20 includes a frame body 21 and a movable terminal connecting mechanism 22. The frame body 21 includes an entrance 211 and a receptacle 212. The movable terminal connecting mechanism 22 is received in the receptacle 212 of the frame body 21. The movable terminal connecting mechanism 22 includes a support part 24, a carrier part 25 and a first terminal block 26. The first terminal block 26 is fixed on the carrier part 25. The carrier part 25 is movable with respect to the support part 24 such that the first terminal block 26 is either partially exposed outside the entrance 211 of the frame body 21 or stored within the frame body 21. Once the first terminal block 26 is exposed outside the entrance 211, the worker may implement the wiring task. In addition, the electrical appliance 2 further includes a cover plate 23 for shielding the entrance 211 of the frame body 21. The cover plate 23 has several perforations 231 for penetrating external cables (not shown) therethrough.

Figure 3:
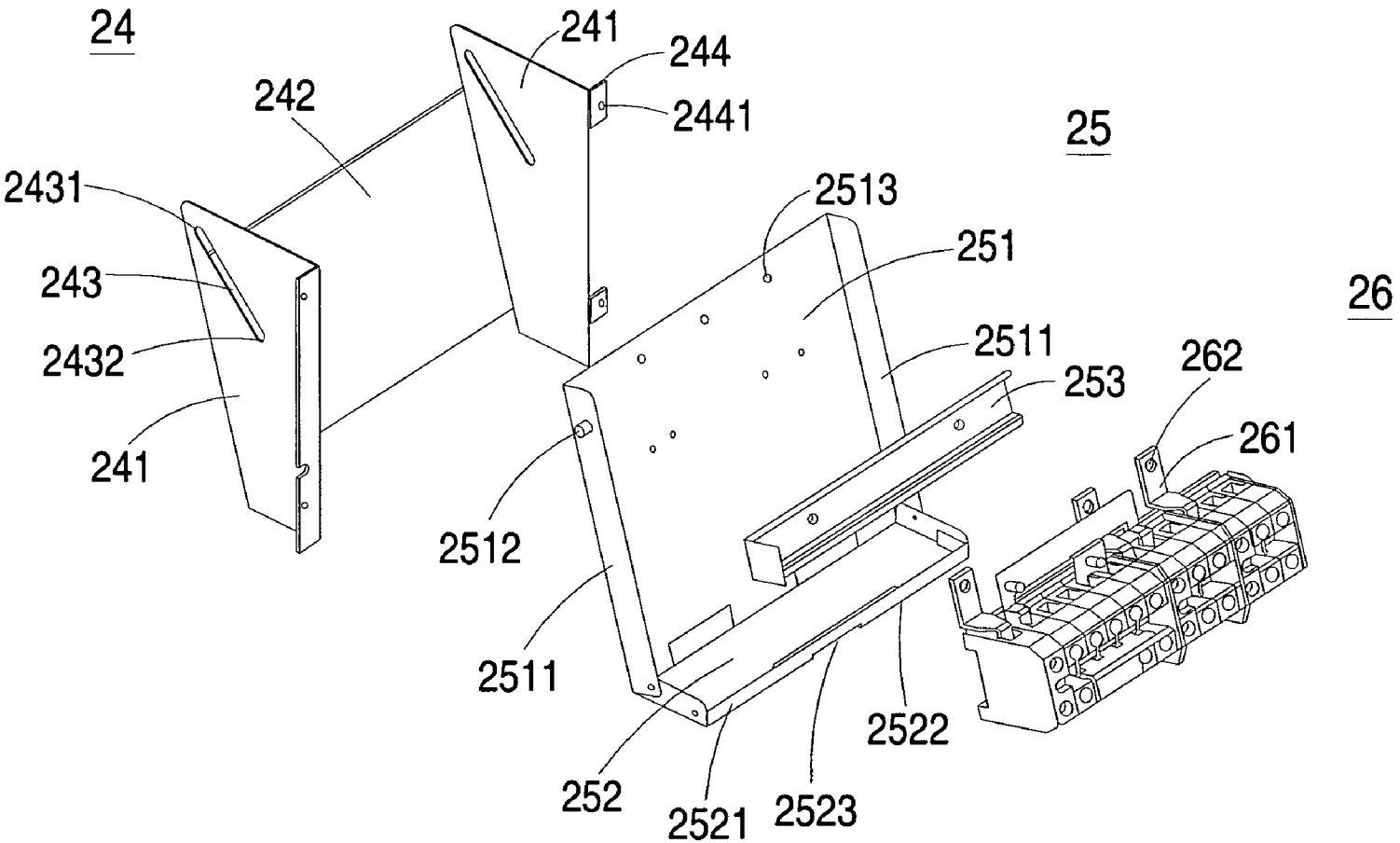
FIG. 3 is a schematic exploded view of the movable terminal connecting mechanism according to a first preferred embodiment of the present invention.

Referring to FIG. 3, a schematic exploded view of the movable terminal connecting mechanism according to a first preferred embodiment of the present invention is illustrated. As shown in FIG. 2 and FIG. 3, the support part 24 of the movable terminal connecting mechanism 22 includes a pair of parallel lateral plates 241. Each of the lateral plates 241 has a first retaining structure 243. An exemplary first retaining structure 243 includes but is not limited to a guiding track or a salient (not shown). The first retaining structure 243 has a first retaining point 2431 and a second retaining point 2432. Optionally, several ear structures 244 are extended from at least one lateral plate 241 of the support part 24. Each ear structure 244 has one or more openings 2441. By penetrating fastening elements such as screws through corresponding openings 2441 of the ear structures 244, the support part 24 is fixed on the inner surface of the frame body 21. Alternatively, the support part 24 may be fixed on the inner surface of the frame body 21 by welding or other connecting means. Optionally, the support part 24 further includes a backside plate 242, which is interconnected between these two lateral plates 241 for enforcing the structural strength of the support part 24.

Please refer to FIG. 2 and FIG. 3 again. The carrier part 25 includes a first carrier plate 251 and a second carrier plate 252. The lower edge of the first carrier plate 251 is connected to the second carrier plate 252. The first carrier plate 251 is substantially perpendicular to the second carrier plate 252. In addition, corresponding to the lateral plates 241 of the support part 24, two side plates 2511 are extended from bilateral sides of the first carrier plate 251. These two side plates 2511 are parallel with each other. The side plates 2511 have respective second retaining structures 2512 corresponding to the first retaining structures 243 of the support part 24. In a case that the first retaining structures 243 are guiding tracks, the second retaining structures 2512 are salients. In another case that the first retaining structures 243 are salients, the second retaining structures 2512 are guiding tracks. When the second retaining structures 2512 are moved with respect to the first retaining structures 24, the carrier part 25 is moved with respect to the support part 24.

Please refer to FIG. 2 and FIG. 3 again. The first terminal block 26 is directly attached on the first carrier plate 251 or the second carrier plate 252 of the carrier part 25. The carrier part 25 further includes a fixture element 253 for facilitating fixing the first terminal block 26 on the first carrier plate 251. Alternatively, the first terminal block 26 may be coupled to the carrier part 25 by welding, screwing, fastening, riveting or other connecting means. In addition, the first terminal block 26 has several ear structures 261. The ear structures 261 have openings 262 corresponding to the screw holes 2513 in the first carrier plate 251. By penetrating fastening elements such as screws (not shown) through corresponding openings 262 of the ear structures 261 and the screw holes 2513 of the first carrier plate 251, the first terminal block 26 is fixed on the first carrier plate 251 and grounded through the first carrier plate 251. In addition, the first terminal block 26 has wiring holes (not shown) to be coupled with external cables.

Figure 4:
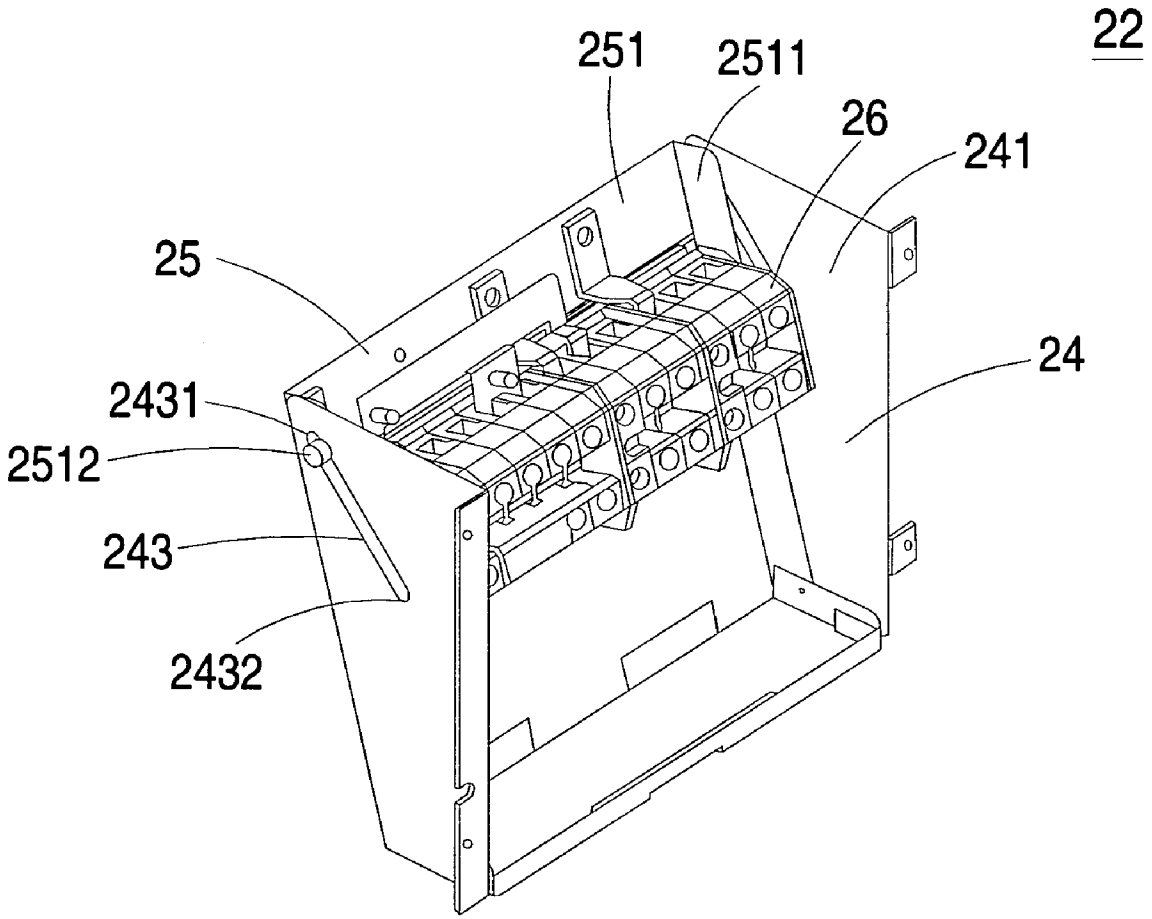
FIG. 4 is a schematic assembled view of the movable terminal connecting mechanism of FIG. 3.

FIG. 4 is a schematic assembled view of the movable terminal connecting mechanism of FIG. 3. As shown in FIG. 4, the first terminal block 26 is fixed on the carrier part 25. The first carrier plate 251 of the carrier part 25 is disposed in front of the backside plate 242 of the support part 24. The side plates 2511 of the first carrier plate 251 are disposed beside the lateral plates 241 of the support part 24. The first retaining structures 243 and the second retaining structures 2512 are guiding tracks and salients, respectively. As the second retaining structures 2512 are moved between the first retaining points 2431 and the second retaining points 2432 of the first retaining structures 243, the carrier part 25 and the first terminal block 26 which is fixed on the carrier part 25 are moved with respect to the support part 24.

Figure 5A:
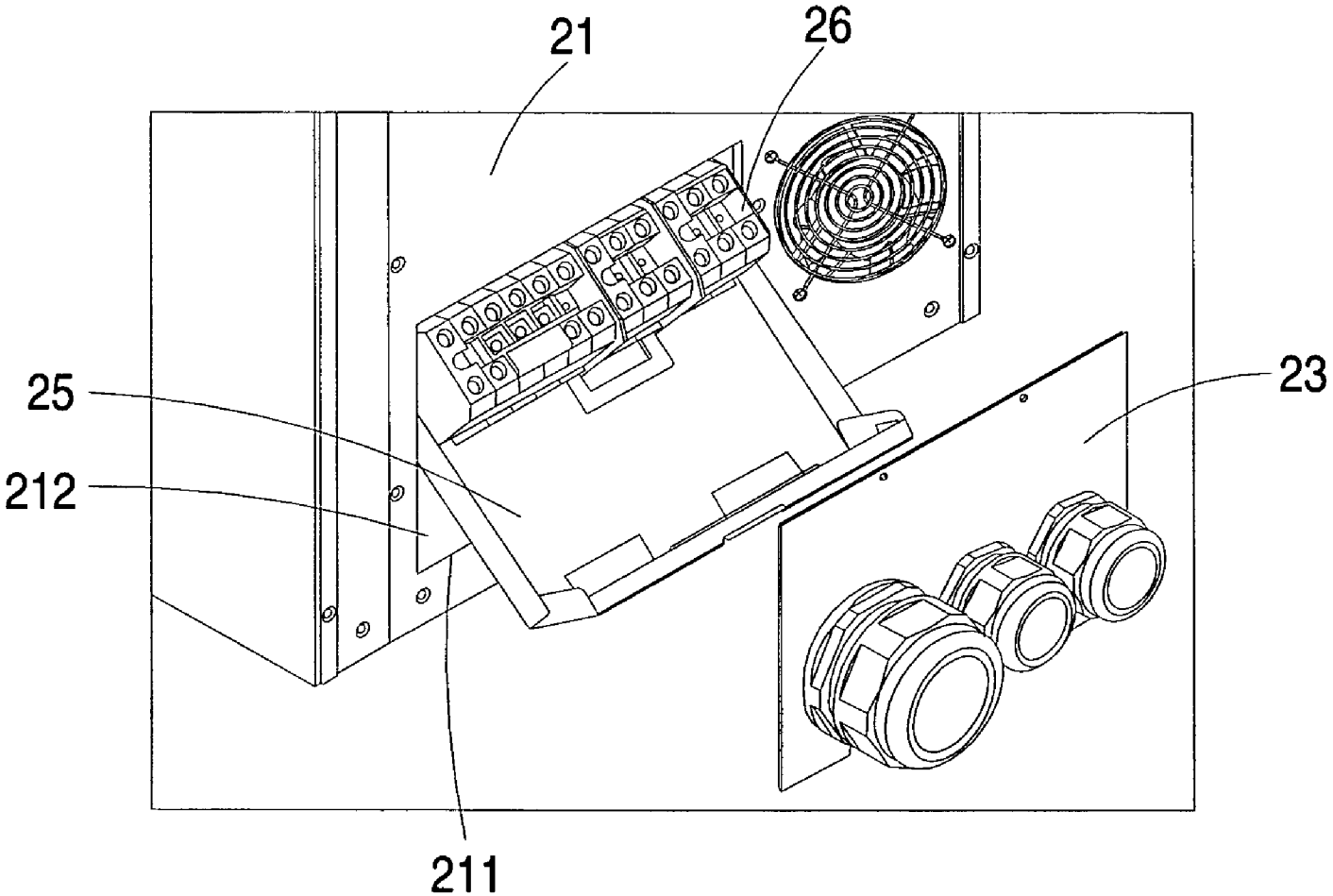
FIG. 5(*a*) is a schematic partial backside view illustrating that the movable terminal connecting mechanism of the electrical appliance is partially exposed outside the entrance of the frame for implementing the wiring task.
Figure 5B:
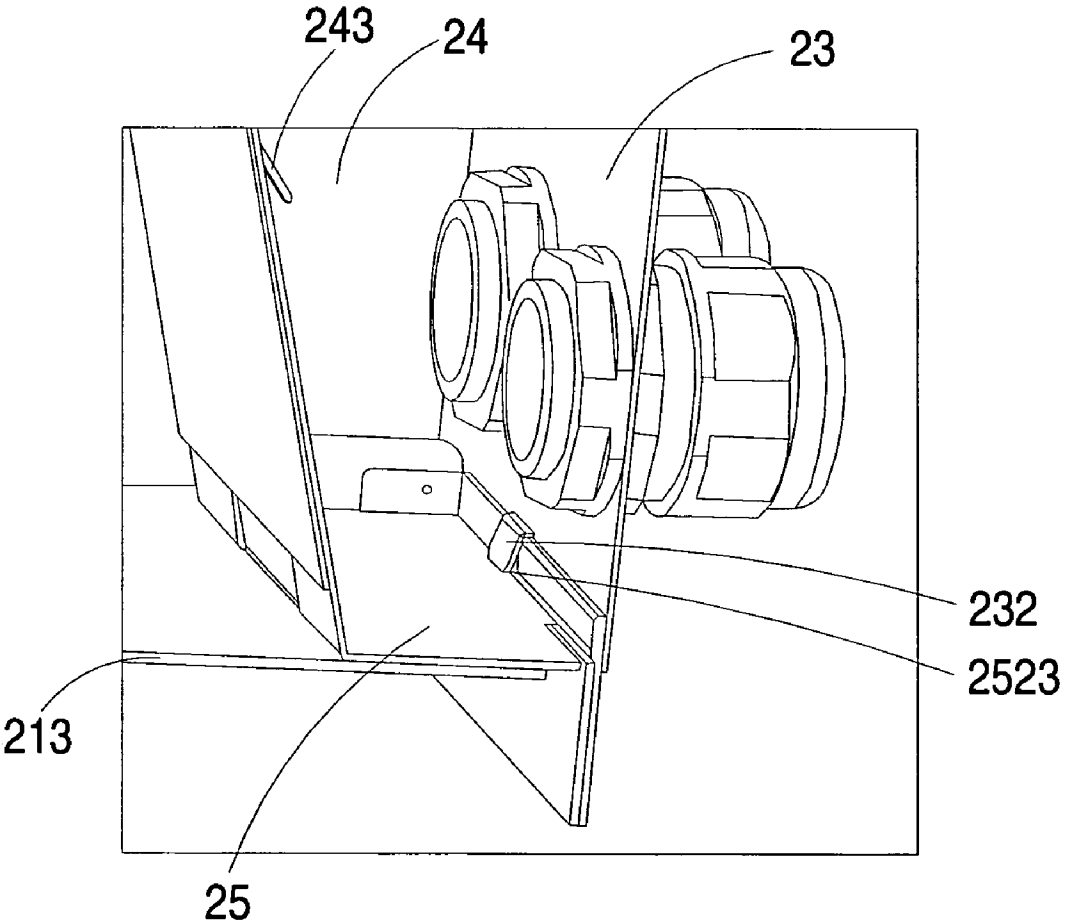

FIG. 5(*a*) is a schematic partial backside view illustrating that the movable terminal connecting mechanism of the electrical appliance is partially exposed outside the entrance of the frame for implementing the wiring task. In FIG. 5(*a*), the cover plate 23 is detached from the movable terminal connecting mechanism 22. Please refer to FIGS. 2, 3, 4 and 5(*a*). The support part 24 is received in the receptacle 212 of the frame body 21. As the second retaining structures 2512 are moved with the first retaining structures 243, the carrier part 25 is movable with respect to the support part 24. After the cover plate 23 is detached and a pulling force is applied on the carrier part 25, the second retaining structures 2512 are moved from the first retaining points 2431 to the second retaining points 2432 of the first retaining structures 243. Meanwhile, the carrier part 25 and the first terminal block 26 which is fixed on the carrier part 25 are partially exposed outside the entrance 211 of the frame body 21. Therefore, the worker may easily implement the wiring task of wiring the first terminal block 26 with external cables.

FIG. 5(*b*) is a schematic partial backside view illustrating that the movable terminal connecting mechanism of the electrical appliance is shielded by the cover plate. Please refer to FIGS. 2, 3, 4 and 5(*b*). In a case that no wiring task needs to be done or the wiring task has been done, a pushing force may be exerted on the carrier part 25 to move the second retaining structures 2512 from the second retaining points 2432 to the first retaining points 2431 of the first retaining structures 243. Meanwhile, the carrier part 25 and the first terminal block 26 are both stored within the receptacle 212 of the frame body 21. Afterwards, the cover plate 23 is placed on the frame body 21 to shield the entrance 211 of the frame body 21, thereby enhancing electrical safety.

Please refer to FIGS. 5(*a*) and 5(*b*) again. After the carrier part 25 is stored within the receptacle 212 of the frame body 21, the carrier part 25 is supported on the bottom inner surface 213 of the frame body 21. Meanwhile, the second retaining structures 2512 are positioned at the first retaining points 2431 without sliding or shifting. Optionally, as shown in FIG. 3 and FIG. 5(*b*), an extension plate 2521 is extended from a front edge of the second carrier plate 252 of the carrier part 25. The extension plate 2521 is substantially perpendicular to the second carrier plate 252. After the carrier part 25 is stored within the receptacle 212 of the frame body 21, the extension plate 2521 is sustained against the lower inner periphery of the entrance 211 of the frame body 21. In addition, a first engaging structure 2523 is formed at the interface 2522 between the extension plate 2521 and the second carrier plate 252. The cover plate 23 has a second engaging element 232 corresponding to the first engaging structure 2523. The engagement between the first engaging structure 2523 and the second engaging structure 232 may facilitate fixing the cover plate 23 on the carrier part 25. In this embodiment, the first engaging structure 2523 and the second engaging structure 232 are a recess and a protrusion, respectively.

It is noted that, however, those skilled in the art will readily observe that numerous modifications and alterations may be made while retaining the teachings of the invention. For example, the second carrier plate 252 of the carrier part 25 may be dispensed with; and the first carrier plate 251 and the bottom inner surface 213 of the frame body 21 may have corresponding engaging structures (not shown). After the carrier part 25 is stored within the receptacle 212 of the frame body 21, the carrier part 25 is supported on the bottom inner surface 213 of the frame body 21 due to the engagement of these engaging structures. Alternatively, additional auxiliary retaining indentations (not shown) may be provided in the vicinity of the first retaining points 2431 and the second retaining points 2432 for facilitating positioning the carrier part 25.

Figure 6:
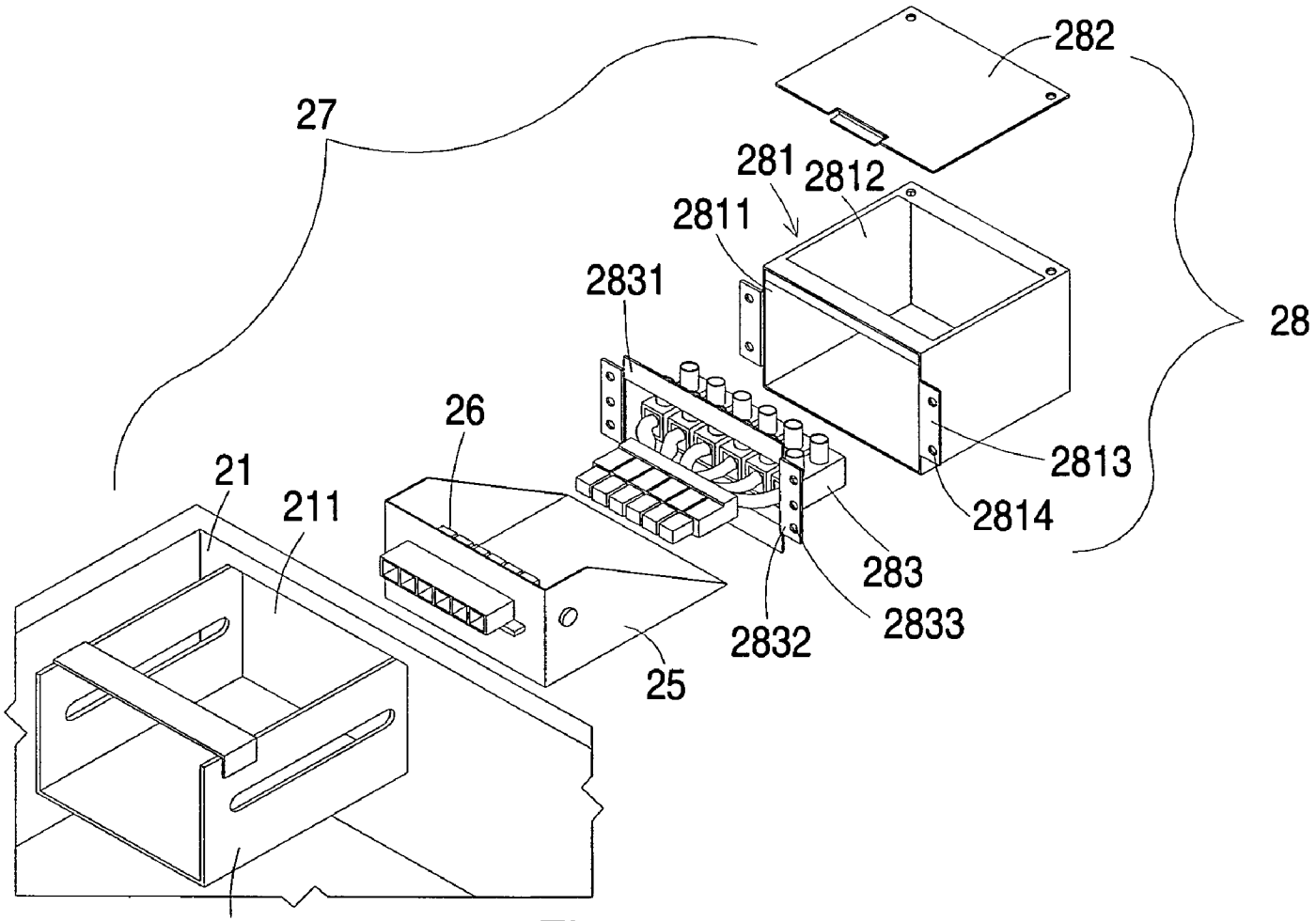
FIG. 6 is a schematic exploded view of a movable terminal connecting mechanism according to a second preferred embodiment of the present invention.

Referring to FIG. 6, a schematic exploded view of a movable terminal connecting mechanism according to a second preferred embodiment of the present invention is illustrated. As shown in FIG. 6, the movable terminal connecting mechanism 27 includes a support part 24, a carrier part 25, a first terminal block 26 and an external shielding box 28. In this embodiment, the operation principles of the support part 24, the carrier part 25 and the first terminal block 26 included therein are similar to those shown in FIGS. 2 and 3, and are not redundantly described herein. Especially, the carrier part 25 is movable with respect to the support part 24 along the horizontal direction rather than the slanted direction. The external shielding box 28 is placed on the frame body 21 to shield the entrance 211 of the frame body 21, thereby enhancing electrical safety. The external shielding box 28 includes a shielding body 281, a cover member 282 and a second terminal block 283. The shielding body 281 has a first gate 2811 and a second gate 2812. The first gate 2811 of the shielding body 281 is faced to the entrance 211 of the frame body 21. The second gate 2812 is arranged in the upper side of the shielding body 281 or opposed to the first gate 2811. The second gate 2812 is shielded by the cover member 282. The shielding body 281 has several perforations (not shown) for penetrating external cables (not shown) therethrough. The second terminal block 283 may have been previously coupled to the external cables. The second terminal block 283 further includes a fastening member 2831 such as a fastening frame. Two ear structures 2832 are extended from bilateral sides of the fastening member 2831. Each ear structure 2832 has one or more openings 2833. Corresponding to the ear structures 2832 and the openings 2833 of the fastening member 2831, the shielding body 281 has ear structures 2813 and openings 2814. By penetrating screwing elements through the openings 2833 and 2813, the shielding body 281 and the second terminal block 283 are secured onto the frame body 21.

Figure 7A:
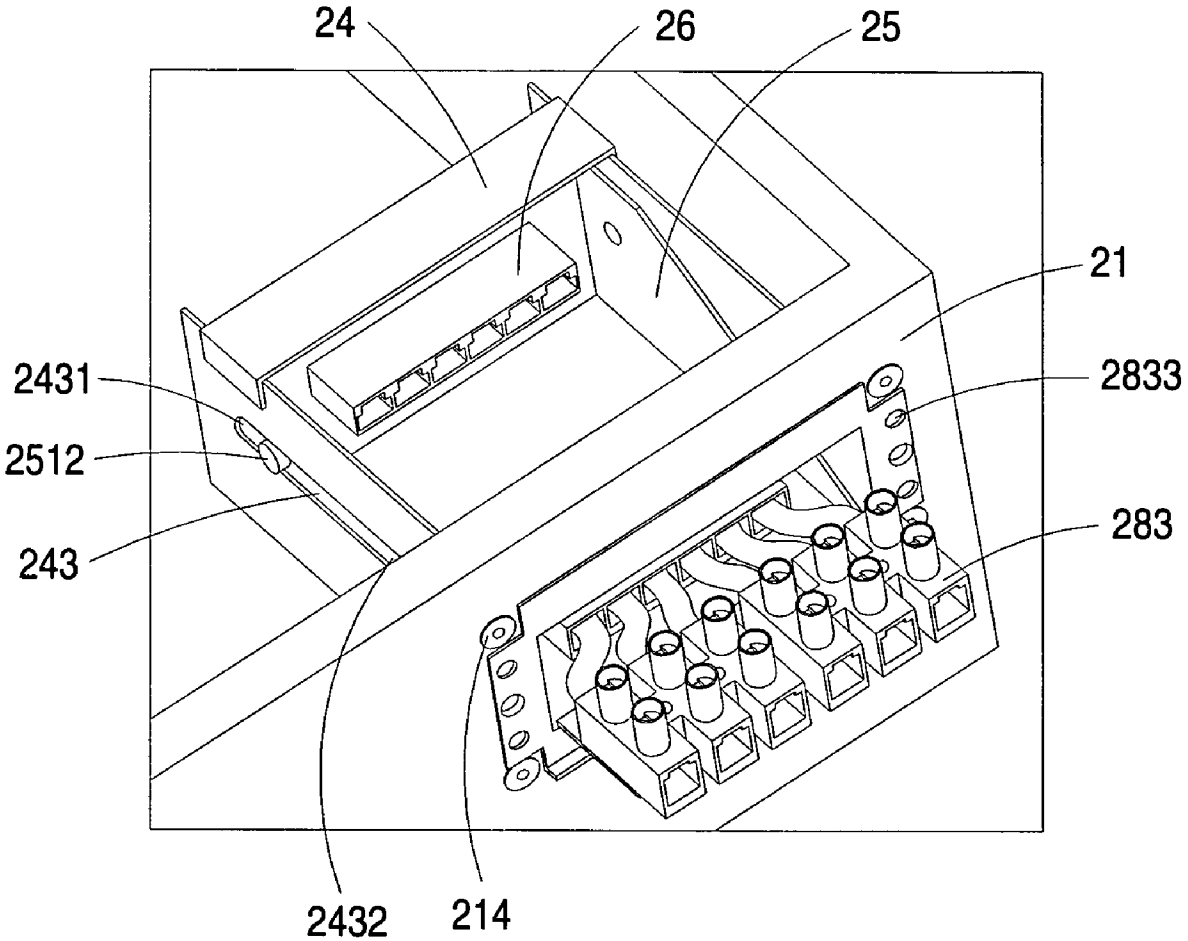
FIG. 7(*a*) is a schematic partial perspective view illustrating the connection between the first terminal block and the second terminal block.
Figure 7B:
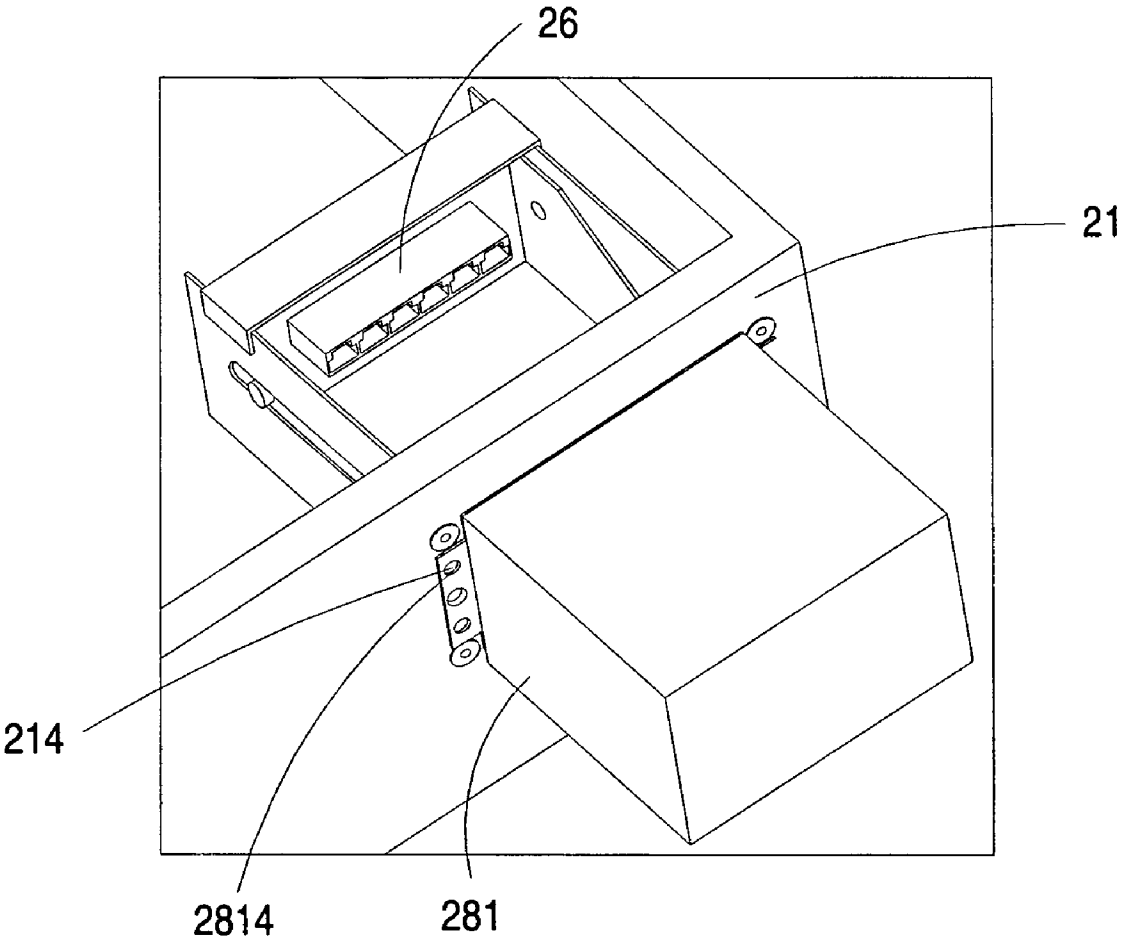

FIG. 7(*a*) is a schematic partial perspective view illustrating the connection between the first terminal block and the second terminal block. As shown in FIG. 6 and FIG. 7(*a*), the support part 24 is fixed within the frame body 21. In response to a pulling force exerted on the carrier part 25, the second retaining structures 2512 are moved from the first retaining points 2431 to the second retaining points 2432 of the first retaining structures 243, and thus the first terminal block 26 which is fixed on the carrier part 25 is partially exposed outside the entrance 211 of the frame body 21. Therefore, the worker may easily implement the wiring task of wiring the first terminal block 26 with the second terminal block 283. After the wiring task has been done, a pushing force may be exerted on the carrier part 25 to move the second retaining structures 2512 from the second retaining points 2432 to the first retaining points 2431 of the first retaining structures 243, and thus the carrier part 25 and the first terminal block 26 are both stored within the receptacle of the frame body 21. Afterwards, the shielding body 281 is placed on the frame body 21 to shield the second terminal block 283, thereby enhancing electrical safety.

FIG. 7(*b*) is a schematic partial perspective view illustrating the connection between the shielding body and the frame body. By penetrating screwing elements (not shown) through the openings 2814 of the shielding body 281, the openings 2833 of the second terminal block 283 and the openings 214 of the frame body 21, the shielding body 281 and the second terminal block 283 are secured onto the frame body 21. Afterwards, the cover member 282 is placed on the shielding body 281 to shield the second gate 2812. Meanwhile, the second terminal block 283 is electrically connected to the first terminal block 26.

From the above description, the movable terminal connecting mechanism may be selectively exposed outside the entrance of the frame by moving the carrier part with respect to the support part, thereby implementing the wiring task in a convenient and user-friendly manner. In a case that the wiring task has been done, the movable terminal connecting mechanism may be stored within the electrical appliance, thereby increasing electrical safety.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A movable terminal connecting mechanism of an electrical appliance, said electrical appliance including a frame having a receptacle and an entrance, said movable terminal connecting mechanism comprising:

a support part fixed within said frame and including at least one first retaining structure;

a carrier part including at least one second retaining structure corresponding to said first retaining structure, wherein said carrier part is moved with respect to said support part when said second retaining structure is moved along said first retaining structure; and a first terminal block fixed on said carrier part to be coupled with an external cable, wherein said first terminal block is either partially exposed outside said entrance of said frame body to implement a wiring task of wiring said first terminal block with said external cable, or stored in said receptacle.

2. The movable terminal connecting mechanism according to claim 1 wherein each said first retaining structure has a first retaining point and a second retaining point, wherein said first terminal block is partially exposed outside said entrance of the frame body when said carrier part is moved from said first retaining point to said second retaining point, and said first terminal block is stored in said receptacle when said carrier part is moved from said second retaining point to said first retaining point.

3. The movable terminal connecting mechanism according to claim 1 wherein said support part further includes two lateral plates and a backside plate interconnected between said two lateral plates, and said at least one first retaining structure includes multiple first retaining structures arranged on said two lateral plates.

4. The movable terminal connecting mechanism according to claim 3 wherein said carrier part further includes first carrier plate and a second carrier plate, two side plates are extended from bilateral sides of said first carrier plate corresponding to said lateral plates of said support part, and said at least one second retaining structure includes multiple second retaining structures arranged on said two extension plates.

5. The movable terminal connecting mechanism according to claim 4 wherein said first retaining structures are guiding tracks and said second retaining structures are salients.

6. The movable terminal connecting mechanism according to claim 4 wherein said first retaining structures are salients and said second retaining structures are guiding tracks.

7. The movable terminal connecting mechanism according to claim 4 wherein said second carrier plate is connected to said first carrier plate, an extension plate is extended from an edge of said second carrier plate, and a first engaging structure is formed at an interface between said extension plate and said second carrier plate.

8. The movable terminal connecting mechanism according to claim 7 wherein said electrical appliance further includes a cover plate for shielding said entrance of said frame body, and said cover plate has several perforations allowing said external cables to penetrate therethrough.

9. The movable terminal connecting mechanism according to claim 8 wherein a second engaging structure is formed on said cover plate corresponding to said first engaging structure.

10. The movable terminal connecting mechanism according to claim 9 wherein said first engaging structure is a recess and said second engaging structure is a protrusion.

11. The movable terminal connecting mechanism according to claim 1 wherein said electrical appliance further includes an external shielding box for shielding said entrance of said frame body, said external shielding box includes:

a shielding body having a first gate and a second gate, said first gate being faced to said entrance of said frame body;

a cover member for shielding said second gate;

a second terminal block interconnected between said first terminal block and said external cables; and a fastening member for facilitating fastening said second terminal block and said shielding body onto said frame body, wherein said first terminal block is partially exposed outside said entrance of said frame body when said carrier part is moved with respect to said support part, thereby connecting said first terminal block and said second terminal block.

12. The movable terminal connecting mechanism according to claim 11 wherein said shielding body has several perforations allowing said external cables to penetrate therethrough.

13. A movable terminal connecting mechanism of an electrical appliance, said electrical appliance including a frame body having a receptacle and an entrance, said movable terminal connecting mechanism comprising:

a support part fixed within said frame body and including at least one first retaining structure;

a carrier part including at least one second retaining structure corresponding to said first retaining structure, wherein said carrier part is moved with respect to said support part when said second retaining structure is moved with respect to said first retaining structure;

a first terminal block fixed on said carrier part to be coupled with an external cable, wherein said first terminal block is either partially exposed outside said entrance of said frame body or stored in said receptacle; and a second terminal block for interconnecting said first terminal block and said external cables when said first terminal block is partially exposed outside said entrance of said frame body.

14. The movable terminal connecting mechanism according to claim 13 wherein each first retaining structure has a first retaining point and a second retaining point, wherein said first terminal block is partially exposed outside said entrance of the frame body when said carrier part is moved from said first retaining point to said second retaining point, and said first terminal block is stored in said receptacle when said carrier part is moved from said second retaining point to said first retaining point.

15. The movable terminal connecting mechanism according to claim 13 wherein said support part further includes two lateral plates and a backside plate interconnected between said two lateral plates, and said at least one first retaining structure includes multiple first retaining structures arranged on said two lateral plates.

16. The movable terminal connecting mechanism according to claim 15 wherein said carrier part further includes first carrier plate and a second carrier plate, two side plates are extended from bilateral sides of said first carrier plate corresponding to said lateral plates of said support part, and said at least one second retaining structure includes multiple second retaining structures arranged on said two extension plates.

17. The movable terminal connecting mechanism according to claim 16 wherein said first retaining structures are guiding tracks and said second retaining structures are salients.

18. The movable terminal connecting mechanism according to claim 16 wherein said first retaining structures are salients and said second retaining structures are guiding tracks.

19. The movable terminal connecting mechanism according to claim 13 wherein said electrical appliance further includes:

a shielding body having a first gate and a second gate, said first gate being faced to said entrance of said frame body;

a cover member for shielding said second gate; and a fastening member for facilitating fastening said second terminal block and said shielding body onto said frame body.

20. The movable terminal connecting mechanism according to claim 19 wherein said shielding body has several perforations allowing said external cables to penetrate therethrough.

* * * * *